US007081867B1

(12) United States Patent
Wang

(10) Patent No.: US 7,081,867 B1
(45) Date of Patent: Jul. 25, 2006

(54) ANTENNA APPARATUS

(75) Inventor: Cheng-Si Wang, Changhua Hsien (TW)

(73) Assignee: Trans Electric Co., Ltd., Changhua Hsien (TW)

( * ) Notice: Subject to any disclaimer, the term of this patent is extended or adjusted under 35 U.S.C. 154(b) by 0 days.

(21) Appl. No.: 11/037,237

(22) Filed: Jan. 19, 2005

(51) Int. Cl.
*H01Q 3/02* (2006.01)

(52) U.S. Cl. ..... 343/882; 343/757

(58) Field of Classification Search ..... 343/757, 343/878, 880, 882
See application file for complete search history.

(56) References Cited

U.S. PATENT DOCUMENTS 6,215,445 B1 * 4/2001 Chang ..... 343/702
6,999,034 B1 * 2/2006 Tsai et al. ..... 343/715
2004/0257299 A1 * 12/2004 Tai et al. ..... 343/906
2005/0024276 A1 * 2/2005 Izumi ..... 343/702
2005/0116877 A1 * 6/2005 Wu ..... 343/882

* cited by examiner

*Primary Examiner*—Shih-Chao Chen
(74) *Attorney, Agent, or Firm*—Lowe, Hauptman & Berner LLP

(57) ABSTRACT

An antenna apparatus includes a bracket and a signal receiving box. The bracket has a base, a first connecting rod rotatably mounted on the base, and a second connecting rod pivotally mounted on the first connecting rod. The signal receiving box is rotatably mounted on the second connecting rod. Whereby, the signal receiving box can be adjusted at any angle for clearly and effectively receiving both the horizontal and the vertical signals.

7 Claims, 6 Drawing Sheets

ANTENNA APPARATUS

BACKGROUND OF THE INVENTION

1. Field of the Invention

The present invention relates to an antenna apparatus for receiving digital signals, and especially relates to an antenna apparatus which can be adjusted to a proper direction to receive horizontal or vertical digital signals.

2. Description of Related Art

A general digital antenna has a base and a signal receiving board fixedly mounted on the base.

When the antenna is receiving signals, the nonadjustable signal receiving board can perform well in receiving vertical signals. However, the horizontal signals can not be received clearly due to the direction of the signal receiving board. For solving the problem, a user must adjust the antenna and even rest it at a horizontal position for receiving horizontal signals. Thus, it is clearly inconvenient to so adjust the antenna.

Therefore, the invention provides an antenna apparatus to mitigate or obviate the aforementioned problems.

SUMMARY OF THE INVENTION

The main objective of the present invention is to provide an antenna apparatus which can be adjusted to effectively receive both horizontal and vertical signals.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
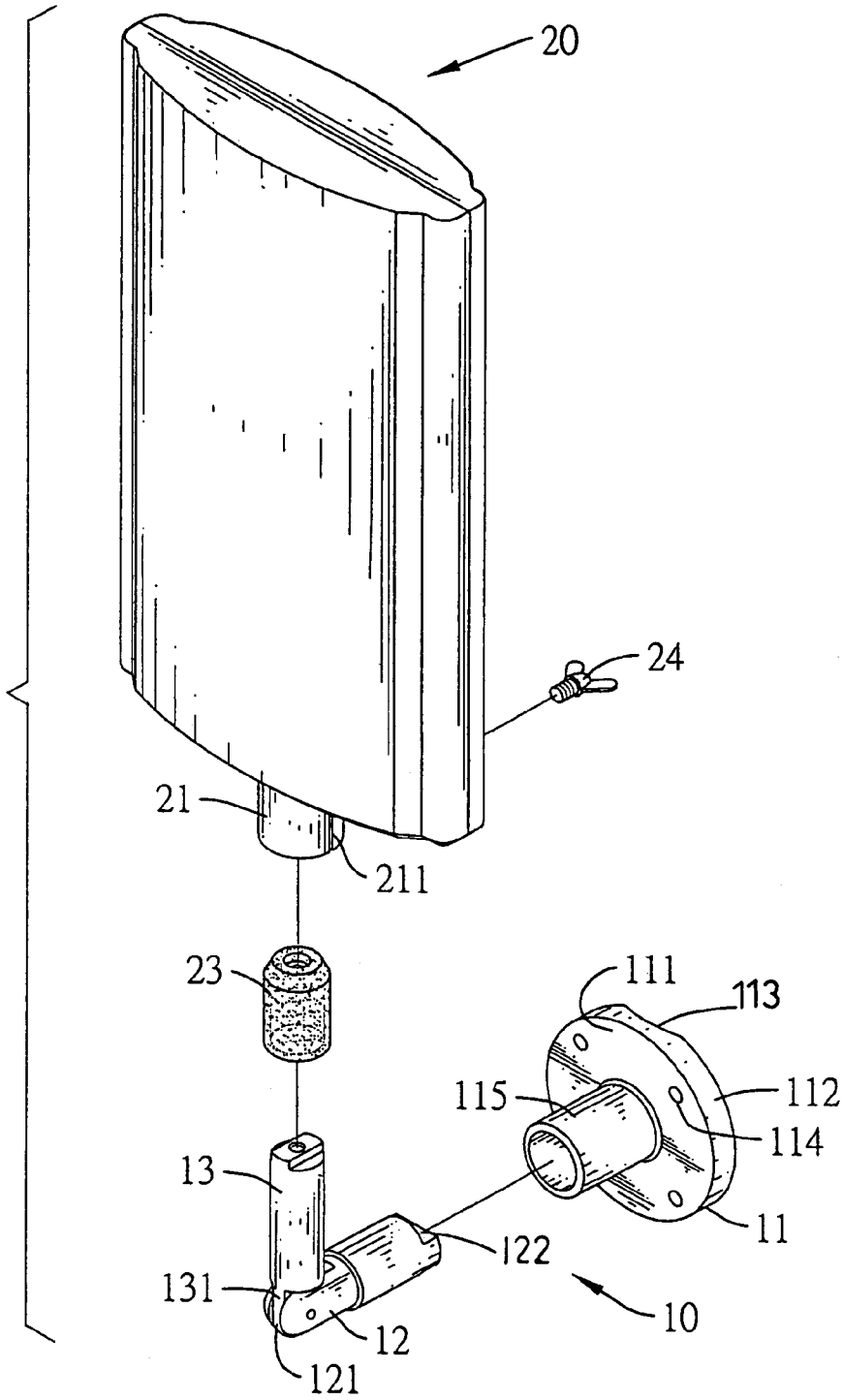
FIG. 1 is an exploded perspective view of an antenna apparatus in accordance with this invention.

With reference to FIGS. 1–5, an antenna apparatus has a bracket (10) including a base (11), a first connecting rod (12) and a second rod (13).

The base (11) is formed with a plate (111) having a front side and a back side and an outer periphery (112) between the front side and back side. The outer periphery (112) has two notches (113) defined at two diametrically opposite sides thereof. Four holes (114) are evenly defined at the front side of the base (11). A sleeve (115) is mounted on the center of the base (11).

The first connecting rod (12) has a slot (121) defined at a first end thereof, and a first bush (122) provided at a second end thereof and rotatably received in the sleeve (115).

The second connecting rod (13) has a tongue (131) formed at a first end thereof and pivotally mounted in the slot (121) of the first connecting rod (12).

A signal receiving board (20) has a stub (21) formed at a lower side thereof. The stub (21) has an open end for receiving a second end of the second connecting rod (13). A second bush (23) is provided between the stub (21) and the second end of the second connecting rod (13). A channel (211) is longitudinally defined through an outer periphery of the stub (21) and a threaded hole (212) is radially defined through the outer periphery of the stub (21). The signal receiving board (20) is rotatably mounted on the second connecting rod (13) and can be fastened by a screw (24) threadingly inserted in the threaded hole (212) to press the second bush (23) towards the second connecting rod (13). In addition, the second bush (23) can be replaced by a ring.

Figure 3:
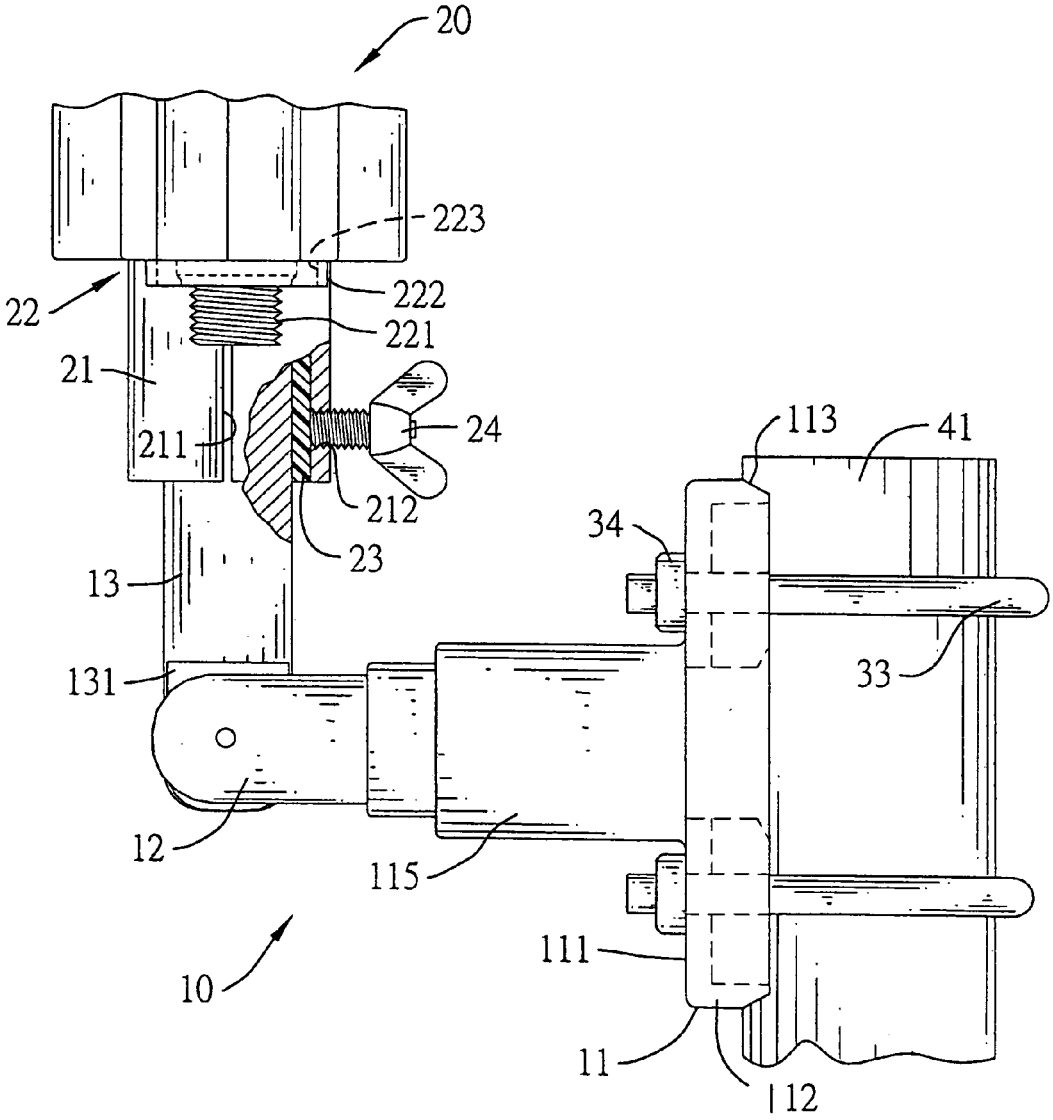
FIG. 3 is a partial side view of the antenna apparatus in accordance with this invention.
Figure 4:
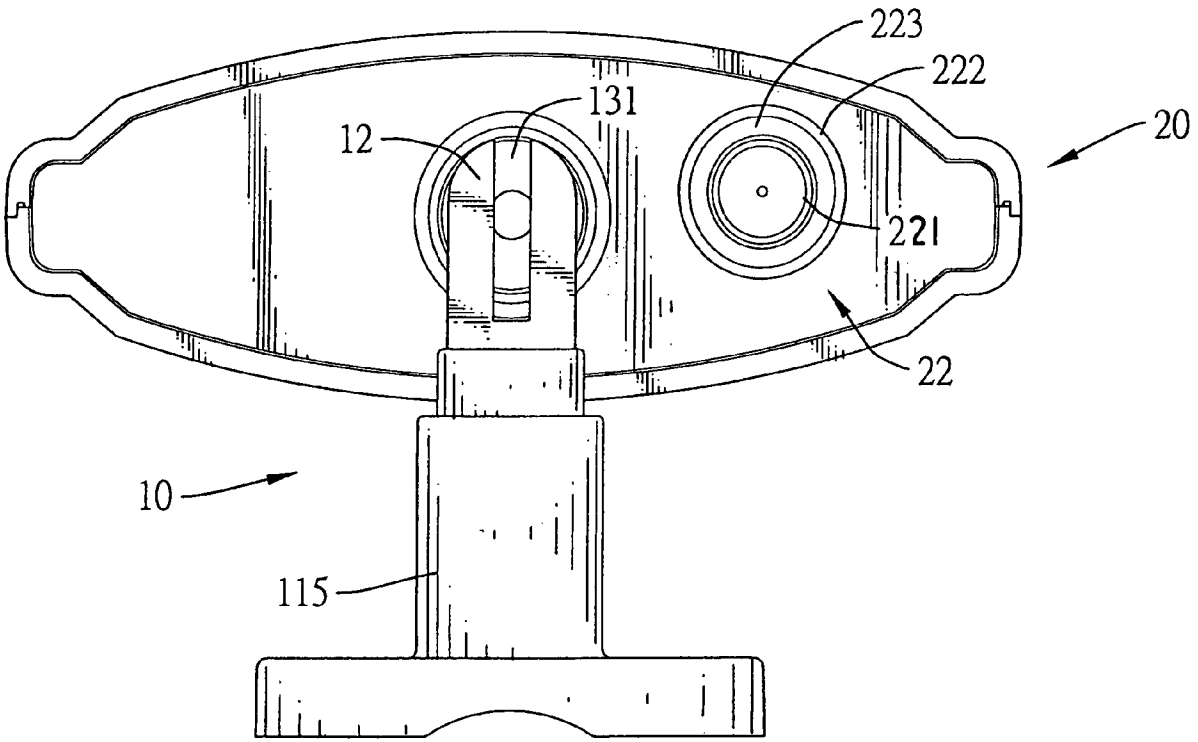
FIG. 4 is a bottom view of the antenna apparatus in accordance with this invention.
Figure 5:
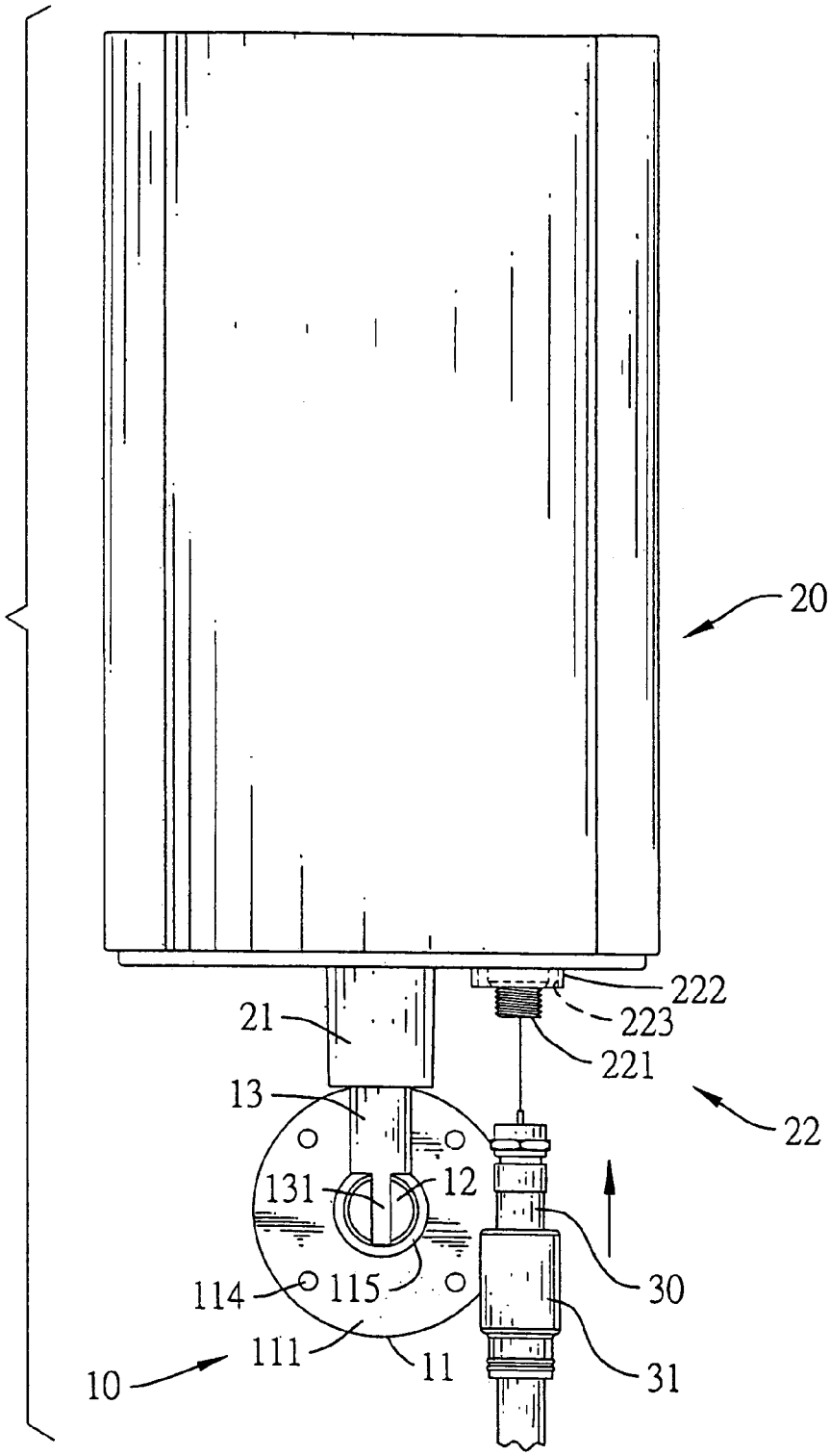
FIG. 5 is a front view of the antenna apparatus in accordance with this invention.

With reference to FIGS. 3 and 5, a cable connector (22) is provided beside the stub (21) and has a coaxial-cable joint (221), a flange (222) formed between the coaxial-cable joint (221) and the signal receiving board (20), and an annular recess (223) defined in the flange (222).

With reference to FIG. 5, when a cable (30) with a waterproof collar (31) is connected to the coaxial-cable joint (221), a front end of the waterproof collar (31) is located in the annular recess (223) to prevent water from penetrating the cable (30), so the antenna can be used in an outdoor location.

Figure 2:
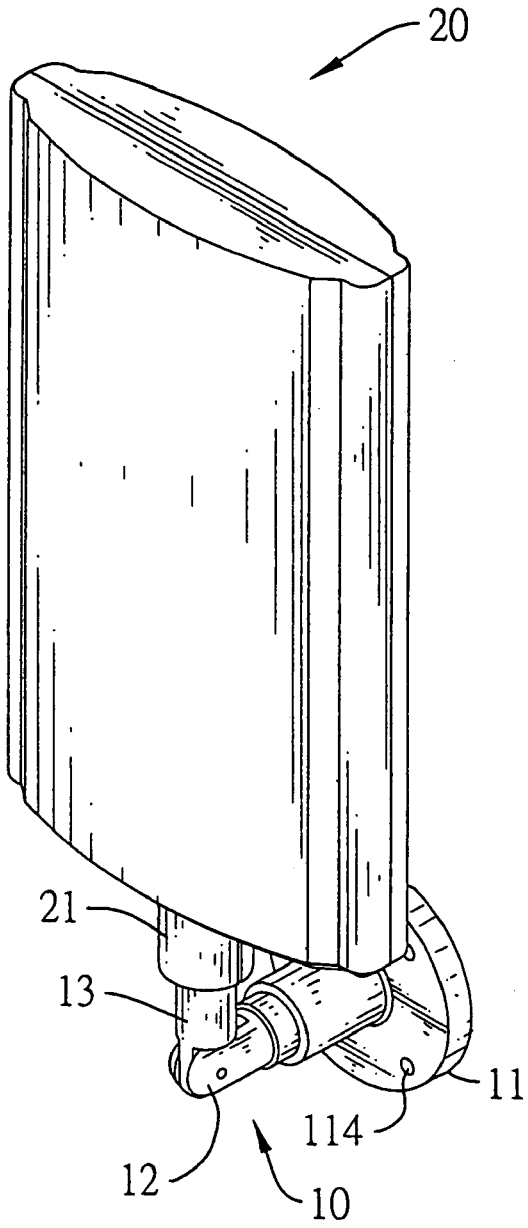
FIG. 2 is a perspective view of the antenna apparatus in accordance with this invention.
Figure 6:
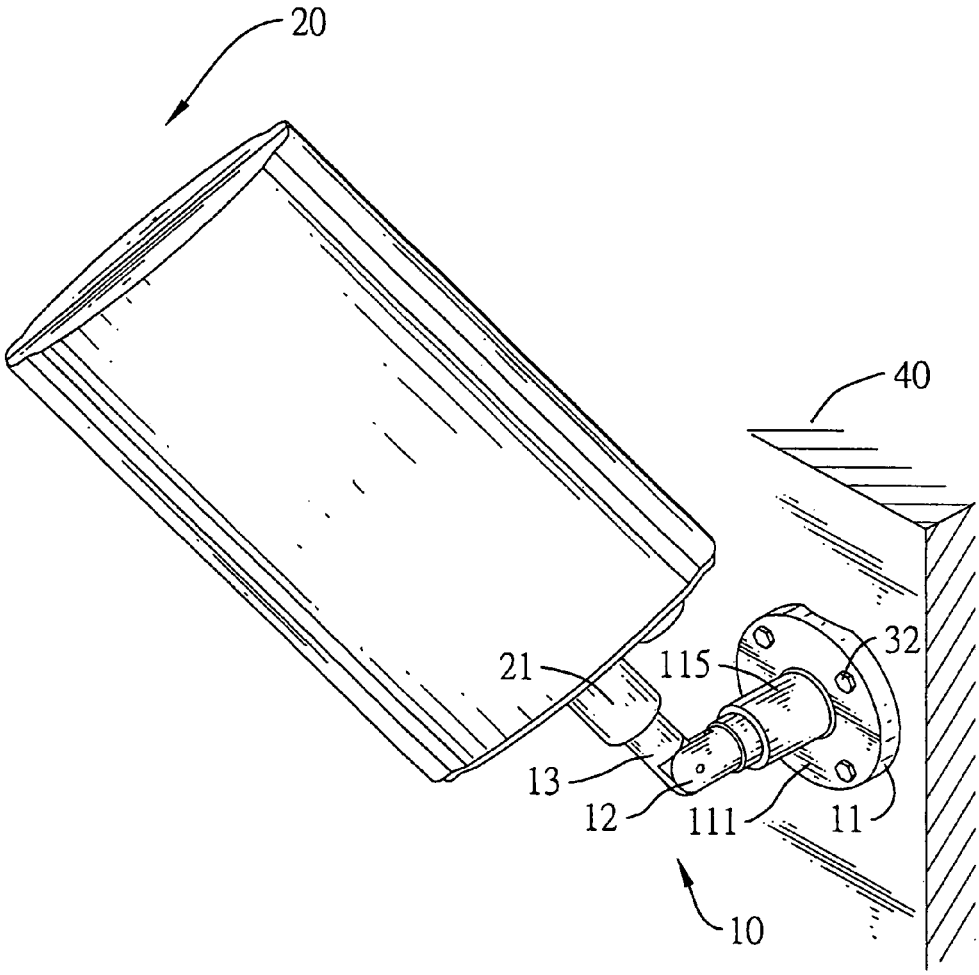
FIG. 6 is a schematically perspective view of the antenna apparatus mounted on the wall and being adjusted.

With reference to FIGS. 2 and 6, the antenna can be fastened on a wall (40) by fasteners (32) such as screws or nails extending through the holes (114).

With reference to FIGS. 2 and 3, the antenna also can be fastened on a pole (41), wherein two stirrups (33) clamp the pole (41) and each have two free ends respectively extending out from the holes (114) and secured by nuts (34).

With reference to FIG. 6, the first connecting rod (12) can freely be pivoted in the sleeve (115), the second connecting rod (13) can be pivoted about the first connecting rod (12) in a plane perpendicular to the base (11) and the signal receiving box (20) can be rotated freely about the second connecting rod (13) when the fastener (24) is released. Therefore, the signal receiving box (20) can be universally pivoted for clearly receiving the vertical or horizontal signals.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna apparatus comprising:

a bracket (10) having a base (11) formed with a plate (111) and a sleeve (115) mounted on the center of the base (11), a first connecting rod (12) having a first end, a second end and a first bush (122) provided on the second end and rotatably received in the sleeve (115), a second connecting rod (13) having a first end pivotally mounted on the first end of the first connecting rod (12) and a second end opposed to the first end; and a signal receiving box (20) having a stub (21) rotatably mounted on the second end of the second connecting rod (13), a second bush (23) provided between the stub (21) and the second end of the second connecting rod (13), and a cable connector (22) formed beside the stub (21) and having a coaxial cable joint (221) provided in the cable connector (22).

2. The antenna apparatus as claimed in claim 1, wherein the stub (21) has a channel (211) longitudinally defined at an outer periphery of the stub (21), and a threaded hole (212) is radially defined through the outer periphery of the stub (21), and a screw (24) is threadingly inserted in the threaded hole (212) for pressing the second bush (23) towards the second connecting rod (13).

3. The antenna apparatus as claimed in claim 1, wherein the cable connector (22) has a flange (222) formed between the coaxial cable joint (221) and the signal receiving box (20), and an annular recess (223) is defined in the flange (222).

4. The antenna apparatus as claimed in claim 2 wherein the cable connector (22) has a flange (222) formed between the coaxial cable joint (221) and the signal receiving box (20), and an annular recess (223) is defined in the flange (222).

5. The antenna as in claim 1 wherein the plate (111) has a front side and a back side and an outer periphery (112) between the front side and back side, two notches (113) are defined at two diametrically opposite sides of the outer periphery (112), and four holes (114) are evenly defined from the front side to the back side of the base (11).

6. The antenna as in claim 2 wherein the plate (111) has a front side and a back side and an outer periphery (112) between the front side and back side, two notches (113) are defined at two diametrically opposite sides of the outer periphery (112), and four holes (114) are evenly defined from the front side to the back side of the base (11).

7. The antenna as in claim 3 wherein the plate (111) has a front side and a back side and an outer periphery (112) between the front side and back side, two notches (113) are defined at two diametrically opposite sides of the outer periphery (112), and four holes (114) are evenly defined from the front side to the back side of the base (11).

* * * * *